US005539498A

United States Patent [19]

De Cock et al.

[11] Patent Number: 5,539,498

[45] Date of Patent: Jul. 23, 1996

[54] PAPER RECEPTOR MATERIAL CONDITIONING APPARATUS AND METHOD

[75] Inventors: Etienne M. De Cock; Lucien A. De Schamphelaere, both of Edegem; Wim M. V. Smet, Temse; Eric F. L. Soulliaert, Edegem; Ludo Verluyten, Holsbeek, all of Belgium

[73] Assignee: Xeikon NV, Mortsel, Belgium

[21] Appl. No.: 257,046

[22] Filed: Jun. 8, 1994

[30] Foreign Application Priority Data

Jun. 18, 1993 [EP] European Pat. Off. ..... 93304774

[51] Int. Cl.[6] ..... G03G 15/00; G03G 21/00

[52] U.S. Cl. ..... 355/200; 355/30; 355/215

[58] Field of Search ..... 355/200, 210, 355/215, 219, 27, 30

[56] References Cited

U.S. PATENT DOCUMENTS

| | | | |
|---|---|---|---|
| 3,653,242 | 4/1972 | Schleich | 355/27 X |
| 3,677,632 | 7/1972 | MacDonald | 355/200 |
| 3,768,906 | 10/1973 | Michelson et al. | 355/100 X |
| 4,193,680 | 3/1980 | Yoshikawa et al. | 355/30 X |
| 4,497,566 | 2/1985 | Ng | 355/208 X |
| 4,542,980 | 9/1985 | Tajima | 355/285 X |
| 4,652,110 | 3/1987 | Sato et al. | 355/315 |
| 4,727,385 | 2/1988 | Nishikawa et al. | 346/153 |
| 4,850,118 | 7/1989 | DeVillez | 34/50 |
| 5,073,796 | 12/1991 | Suzuki et al. | 355/215 |
| 5,099,281 | 3/1992 | Bhagat | 355/217 |
| 5,166,737 | 11/1992 | Tomita | 355/308 |
| 5,411,825 | 5/1995 | Tam | 355/285 X |
| 5,412,459 | 5/1995 | Borsuk et al. | 355/200 X |

FOREIGN PATENT DOCUMENTS

| | | |
|---|---|---|
| 55-134868 | 10/1980 | Japan . |
| 58-174963 | 10/1983 | Japan . |
| 58-217982 | 12/1983 | Japan . |
| 59-017449 | 1/1984 | Japan . |
| 61-185778 | 8/1986 | Japan . |
| 62-280139 | 12/1987 | Japan . |
| 04275580 | 10/1992 | Japan . |
| 1544386 | 4/1979 | United Kingdom . |

OTHER PUBLICATIONS

"Equilibrium Distribution of Charge on a Moving Conducting Film Web" by K. L. Clum Electrostatic Lab, Eastman Kodak Co.

*Primary Examiner*—Fred L. Braun

*Attorney, Agent, or Firm*—Brumbaugh, Graves, Donohue & Raymond

[57] ABSTRACT

A receptor material conditioning apparatus and method for conditioning a moving paper web suitable for use in an electrostatographic printer. A heated drum reduces the moisture content of paper moving along a paper web path. A cooling box positioned downstream of the heated drum cools the moving receptor material. An electrometer determines the electrical condition of the paper before it leaves the apparatus. By conditioning the paper web, a higher yield of toner transfer in the subsequent electrostatographic printer can be obtained.

15 Claims, 4 Drawing Sheets

PAPER RECEPTOR MATERIAL CONDITIONING APPARATUS AND METHOD

FIELD OF THE INVENTION

This invention relates to a paper receptor material conditioning apparatus, in particular to such an apparatus for conditioning a moving paper web prior to entry into an electrostatographic printer.

An electrostatographic printing apparatus is intended for making a large number of prints and finds use, e.g., in the field wherein classical offset printing machines are applied for making thousands of prints in a single run.

BACKGROUND TO THE INVENTION

Electrostatographic printing operates according to the principles and embodiments of non-impact printing as described, e.g., in Principles of Non-Impact Printing by Jerome L Johnson—Palatino Press—Irvine Calif., 92715 USA. Electrostatographic printing includes electrographic printing fn which an electrostatic charge is deposited image-wise on a dielectric recording member as well as electrostatically printing in which an overall electrostatically charged photoconductive dielectric recording member is image-wise exposed to conductivity increasing radiation producing thereby a "direct" or "reversal" toner-developable charge pattern on said recording member.

The toner image is transferred onto a printing stock material, usually paper in the form of a web whereon the toner image is fixed, whereupon the web is cut into sheets containing the desired print frame. As can be learned from the book "The Physics and Technology of Xerographic Processes" by E. M. Williams (1984), Chapter Ten, p. 204 et seq the transfer of developed toner images onto paper proceeds by means of electrical corona devices to generate the required electric field to attract the charged toner from the electrostatographic recording member to the paper. The transfer efficiency of toner onto the receptor paper is not only dictated by the contact of the paper with the toner-laden recording member and the deposited charge but also by the conductivity of the paper and particularly by its water content. Paper is not a simple insulating dielectric, so the electrical properties of plain paper have some influence on toner transfer.

Experiments with a variety of paper types and thicknesses (i.e. weights) have established that heavier papers yield improvement in transfer efficiency. Paper types with high porosity, i.e. high permeability for gases loaded with ions by corona discharge do not allow an efficient toner transfer. Variation in gas permeability or porosity between different paper types is due to overall thickness, degree of filling with clays, sizings, and other paper treating substances.

Apart from the paper fibres and said substances which form a constant factor for conductivity or volume resistivity there is the moisture content which fluctuates with the humidity of the environment, especially the environment of the paper storage unit containing the paper on roll.

It has been established that as the moisture content increases from about 3 to 10% by weight, the surface resistance of copy paper decreases nearly six orders in magnitude. Dry paper has very good electric insulating behaviour so that thereon by corona discharge a fairly high electrostatic charge can be deposited before breakdown takes place. On using dry receptor paper the toner attraction force caused by said electrostatic charge can be built up with a reasonable corona charge. Since the leakage of charges through the receptor paper is a function of moisture content (paper humidity), a careful control of said moisture content will be in favour of toner transfer efficiency, image quality and reproducibility in toner printing results.

It is one object of the present invention to provide an electrostatographic printing apparatus with means for controlling the electrical condition of a paper receptor material whereby a higher yield of transferred toner is obtained and consequently less toner waste is formed, thereby reducing or avoiding quality deviations of transferred toner images and, in the case of double-sided (duplex) printing, improved performance may be achieved as a result of limiting the flow of electrostatic charges through the receptor material.

It is still another object of the present invention to provide a method for conditioning a moving paper receptor material to enable subsequent reproducible production of transferred dry toner images thereon.

SUMMARY OF THE INVENTION

According to the invention, there is provided a paper web conditioning apparatus for conditioning a moving paper receptor material suitable for use in an electrostatographic printer, said apparatus comprising (i) means defining a receptor material path through the apparatus;

(ii) heating means for reducing the moisture content of the receptor material moving along the receptor material path;

(iii) cooling means, positioned downstream of said heating means, for cooling the receptor material moving along the receptor material path; and (iv) sensing means, positioned downstream of said cooling means, to sense the electrical condition of the receptor material.

The paper receptor material may consist of paper or may comprise, for example, paper containing synthetic fibres or paper coated on at least one side with a non-paper material, for example, with a synthetic polymeric material.

Preferably, the moisture control means is enclosed in a heating cabinet having a receptor material entrance, a receptor material exit, means for the entrance of fresh air and exhaust means for expelling moist air produced by heating the receptor material. A cooling cabinet may be provided comprising means for cooling the heated receptor material with dry air to bring its temperature within the range of 15° to 30° C. before leaving the apparatus. Advantageously, the heating cabinet is connected to a cooling cabinet.

Preferably, the conditioning apparatus according to the invention further comprises control means for controlling said heating means, and optionally said cooling means, in response to the electrical condition of the receptor material sensed by said sensing means. Alternatively, the output from the sensing means may be fed to a visual indicator from which the operator may check the condition of the receptor material and make adjustments to the moisture control means to bring the electrical condition of the receptor material within a desired range.

The invention also provides a method for conditioning a moving receptor material for use in an electrostatographic printer, said method comprising:

(i) moving the receptor material along a receptor material path through a conditioning apparatus;

(ii) heating the receptor material moving along the receptor material path to reduce the moisture content thereof;

(iii) subsequently cooling the receptor material along the receptor material path;

(iv) subsequently sensing the electrical condition of the receptor material; and (v) controlling said heating and cooling of the receptor material in response to the sensed electrical condition thereof.

The heating means may comprise a heated rotatable drum or cylinder in contact with at least one side of said receptor material as it moves along said receptor material path.

The heating means may comprise a radiant-heat dryer having at least one radiant-heat source positioned to project infrared radiation onto at least one side of the receptor material as it moves along the receptor material path. Preferably, the radiant-heat dryer has a dominant energy output wavelength within the range of from 1.5 μm to 10 μm. Alternatively or additionally, the moisture control means may comprise at least one nozzle positioned to direct a stream of hot air onto at least one side of the receptor material as it moves along the receptor material path. The heating means may even be a dielectric dryer containing at least one radio-frequency or microwave source positioned such that the receptor material moves through the electromagnetic field of the source as it moves along the receptor material path.

The temperature to which the receptor material is heated by the heating means is preferably at least 120° C., such as about 150° C. Too high a temperature may lead to damage being caused to the receptor material. The receptor material is conditioned to a moisture content of from 1 to 2% by weight, preferably up to 1.5%. We prefer that the moisture content does not fall below 0.5%, since receptor material, which is too dry might result in high triboelectric charges to be generated thereon, the discharge of which in the printer may have undesirable effects.

The sensing means may comprise a corona discharge device positioned adjacent the receptor material path to build up a predetermined electrostatic charge on at least one side of the receptor material and, in a first embodiment, means positioned downstream of the corona discharge device for sensing the level of electrostatic charge retained on the receptor material.

The supply current fed to the corona discharge device is preferably within the range of 1 to 10 μA/cm, most preferably from 2 to 5 μA/cm, depending upon the receptor material characteristics and will be positioned at a distance of from 3 mm to 10 mm from the path of the receptor material.

Alternatively, in a second embodiment, means are positioned downstream of the corona discharge device for sensing the decay of electrostatic charge on said receptor material. The means for sensing the decay of electrostatic charge on said receptor material may comprise a plurality of spaced electrometers positioned adjacent said receptor material path and means for comparing output signals from said electrometers.

Preferably, a receptor material charge discharging device, such as an AC corona device, is positioned downstream of the charge sensing means for discharging the static charge on the receptor material before it leaves the apparatus.

According to a preferred embodiment of the invention, the receptor material conditioning apparatus is coupled to an electrostatographic printer for forming an image onto a receptor material. The printer may comprise at least one toner image-producing electrostatographic station having rotatable endless surface means onto which a toner image can be formed, means for conveying the receptor material past the stations and means for transferring the toner image on the rotatable surface means onto the receptor material.

Preferably, the humidity of the atmosphere inside said electrostatographic printer is controlled. This is done with the aim of maintaining the electrical condition of the receptor material within a desired range.

In preferred embodiments of the invention the receptor material is in the form of a web, for example supplied from a roll, but the invention is equally applicable to receptor material in the form of separate sheets.

PREFERRED EMBODIMENTS OF THE INVENTION

The invention will now be further described, purely by way of example, with reference to the accompanying drawings, in which.

Figure 1:
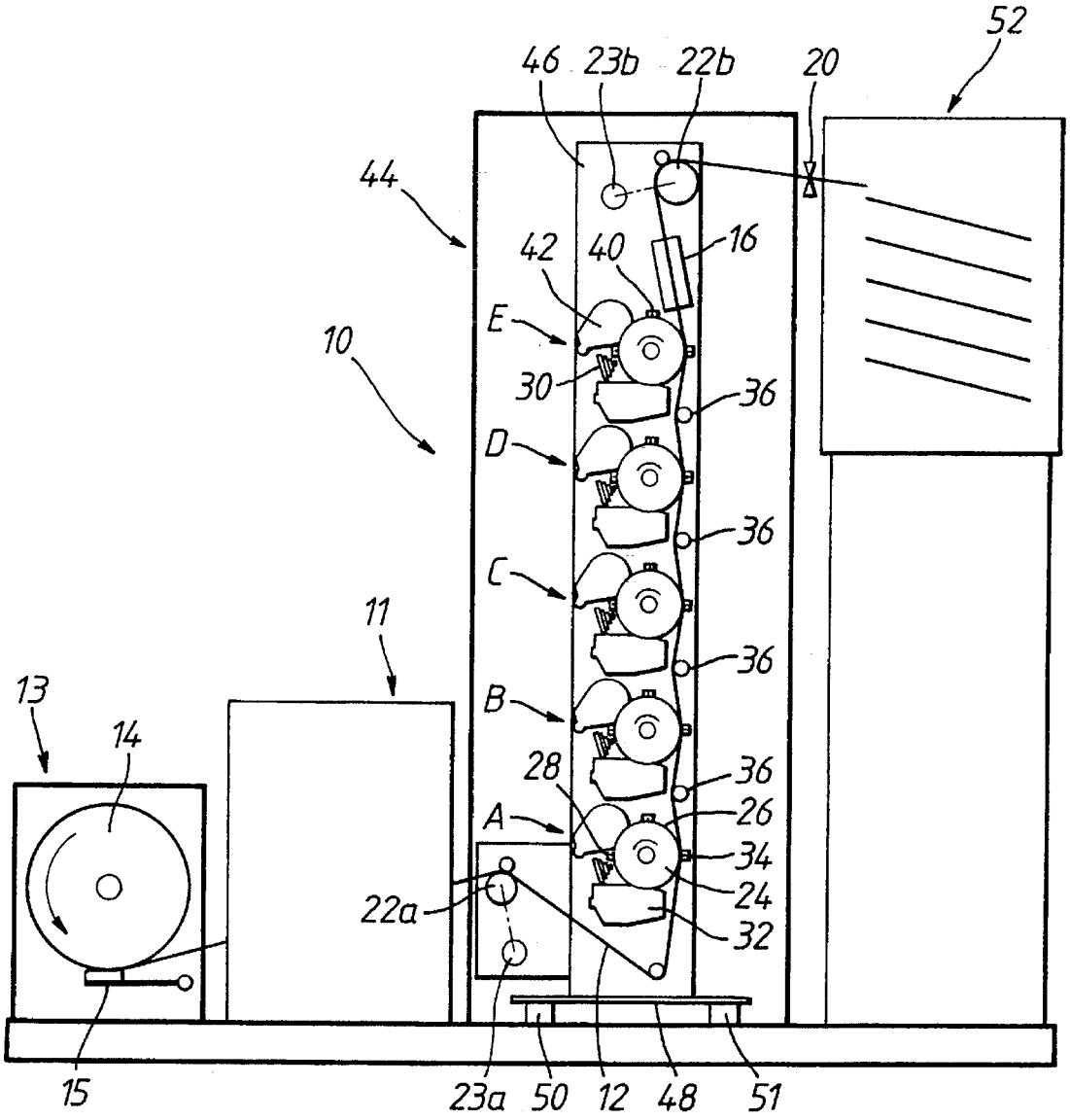
FIG. 1 shows schematically an electrostatographic single-pass multiple station printer, suitable for simplex printing.

Referring to FIG. 1, there is shown a printer 10 having a supply station 13 in which a roll 14 of web material 12 is housed in sufficient quantity to print, say, 3 to 5,000 images. The web 12 is conveyed from the supply station 13, through the paper conditioning apparatus 11 into a tower-like printer housing 44 in which a support column 46 is provided, housing four similar printing stations A to D which are arranged to print yellow, magenta, cyan and black images. In addition, a further station E is provided in order to optionally print an additional colour, for example a specially customised colour. The web of paper 12 is conveyed in an upwards direction past the printing stations in turn.

The printing stations A to E are mounted in a substantially vertical configuration resulting in a reduced footprint of the printer and additionally making servicing easier. The column 46 may be mounted against vibrations by means of a platform 48 resting on springs 50, 51.

After leaving the final printing station E, the image on the web is fixed by means of the image-fixing station 16 and fed to a cutting station 20 (schematically represented) and a stacker 52 if desired.

The web 12 is conveyed through the printer by two drive rollers **22*a*, 22*b* one positioned between the conditioning station 11 and the first printing station A and the second positioned between the image-fixing station 16 and the cutting station 20. The drive rollers 22*a*, 22*b* are driven by controllable motors, 23*a*, 23*b*. One of the motors 23*a*, 23*b*** is speed controlled at such a rotational speed as to convey the web through the printer at the required speed, which may for example be about 125 mm/sec. The other motor is torque controlled in such a way as to generate a web tension of, for example, about 1 N/cm.

Figure 2:
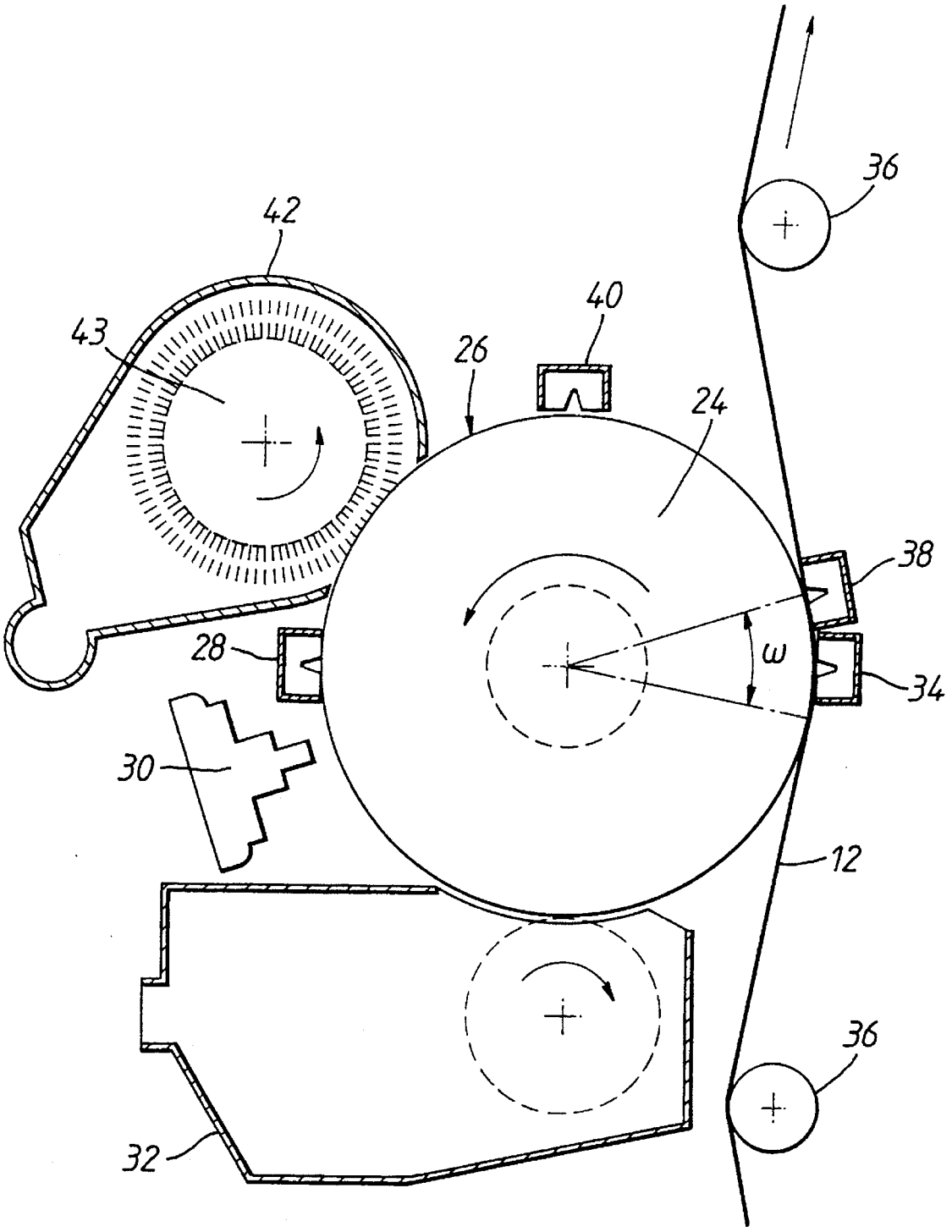
FIG. 2 shows in detail a cross-section of one of the print stations of the printer shown in FIG. 1.

Referring to FIG. 2, each printing station comprises a cylindrical drum 24 having a photoconductive outer surface 26. Circumferentially arranged around the drum 24 there is a charging device 28 capable of uniformly charging the drum surface, an exposure station 30 which will image-wise and line-wise expose the photoconductive drum surface causing the charge on the latter to be selectively dissipated, leaving an image-wise distribution of electric charge to remain on the drum surface. This so-called "latent image" is rendered visible by a developing station 32 which brings a toner developer in contact with the drum surface 26. The toner particles are attracted to the latent image on the drum surface by the electric field between the drum surface and the developer so that the latent image becomes visible.

After development, the toner image adhering to the drum surface 26 is transferred to the moving web 12 by a transfer corona device 34. The moving web 12 is in face-to-face contact with the drum surface 26 over a wrapping angle ω of about 15° determined by the position of guide rollers 36. The transfer corona device, being on the opposite side of the web to the drum, and having a high potential opposite in sign to that of the charge on the toner particles, attracts the toner particles away from the drum surface 26 and onto the surface of the web 12. The transfer corona device typically has its corona wire positioned about 7 nun from the housing which surrounds it and 7 mm from the paper web. A typical transfer corona current is about ±3μA/cm. The transfer corona device 34 also serves to generate a strong adherent force between the web 12 and the drum surface 26, causing the latter to be rotated in synchronism with the movement of the web 12. Circumferentially beyond the transfer corona device 34 there is positioned a web discharge corona device 38 driven by alternating current.

Thereafter, the drum surface 26 is pre-charged by a corona 40, causing any residual toner which might still cling to its surface to become loosened so that it may be collected at a cleaning unit 42 known in the art. The cleaning unit 42 includes a rotating cleaning brush 43. After cleaning, the drum surface is ready for another recording cycle.

After passing the first printing station A, as described above, the web passes successively to printing stations B, C, D and E, where images in other colours are transferred to the web. It is critical that the images produced in successive stations be in register with each other. In order to achieve this, the start of the imaging process at each station has to be critically timed.

Figure 3:
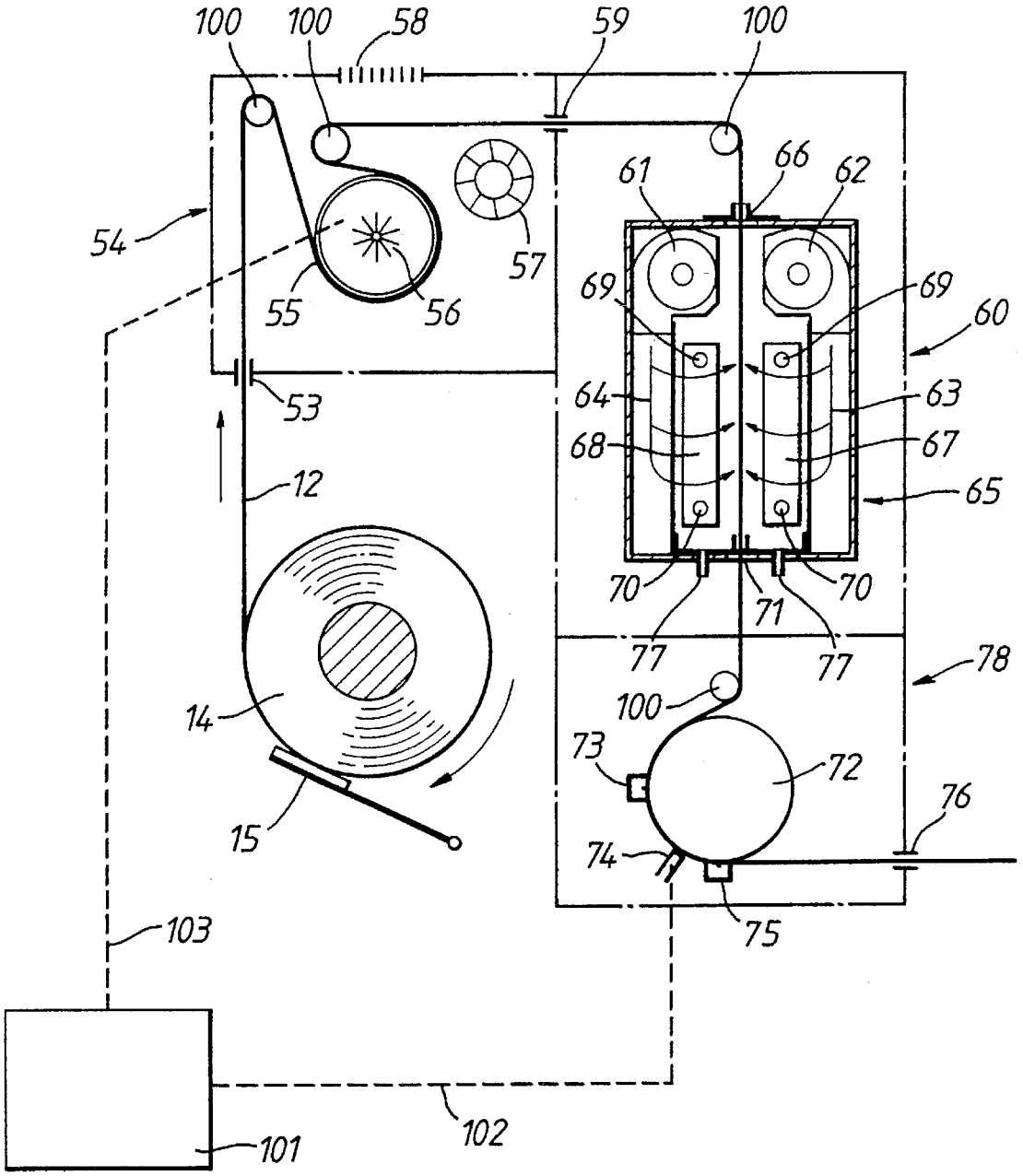
FIG. 3 shows a paper web conditioning apparatus according to the invention, for use with the printer according to FIG. 1.

In the conditioning apparatus shown in FIG. 3, the paper web 12 is unwound from a supply roll 14 and led through an entrance slit 53 into a heating cabinet 54 wherein the paper web 12 follows a curved path defined by a plurality of rollers 100. Between the first and second of said rollers 100, the paper web is in contact with a metal heating drum 55, having a tubular infrared heating source 56 inside. A fan 57 mounted in a wall of the cabinet 54 expels moist air out of the cabinet 54 while ambient air enters through the inlet slits 58. The heated paper web 12 passes through a slot 59 into a cooling cabinet 60, wherein by means of ventilators 61 and 62 cold dry air is circulated along both sides of the paper web 12, as indicated by the arrows 63 and 64. The cooling box 65 has a tight entrance slit 66 closed by a felt brush and contains heat-exchangers 67 and 68 in which circulating cold water (at a temperature of for example 5° to 7° C.) is passed, through cold water inlets 69 and outlets 70. A reservoir (not shown) is connected to the drain holes 77 of the cooling box 65 to collect condensed water which is then led to a drain.

The paper web 12 leaves the cooling box 65 via a tight exit slit 71 and enters a housing 78 containing a sensing means. The paper web 12 follows a curved path into contact with an earthed metal drum 72 and closely adjacent a DC corona discharge unit 73, from which it receives a predetermined corona charge. The paper web 12 then passes an electrometer head 74, downstream of the corona discharge unit 73, which measures the remaining charge level as a voltage which is related to the electrical condition of the paper. The signal from the electrometer head 74 passes via a line 102 to an electronic control device 101. The control device 101 processes said signal in accordance with a previous calibration of the apparatus and controls the supply of electrical power via line 103 to the heating source 56 to automatically adjust the heat energy supply in accordance with the remaining charge level sensed by the electrometer 74 to bring the condition of the paper within the desired range. When the corona current is about 3 μA/cm and the thickness of the paper is about 100 μm, with a weight of 100 g/m$^2$, for good subsequent toner transfer results the electrometer should typically detect a charge height of at least $5.5\times10^2$ V.

An AC discharge corona 75 positioned downstream of the electrometer head 74 brings the paper web back to its ground state before it leaves the housing 78 through the exit slot 76. The paper web passes from the exit slot 76 directly into the printer shown in FIG. 1. By directly coupling the conditioning unit to the printer, the web drive for the printer serves to drive the paper web 12 from its supply roll 14 through the conditioning apparatus, the paper web being maintained in a tensioned state by the brake 15 acting on the roll 14.

The output signal from the electrometer head 74 may alternatively or additionally be fed to a visual indicator from which the operator may check the condition of the paper web.

Figure 4:
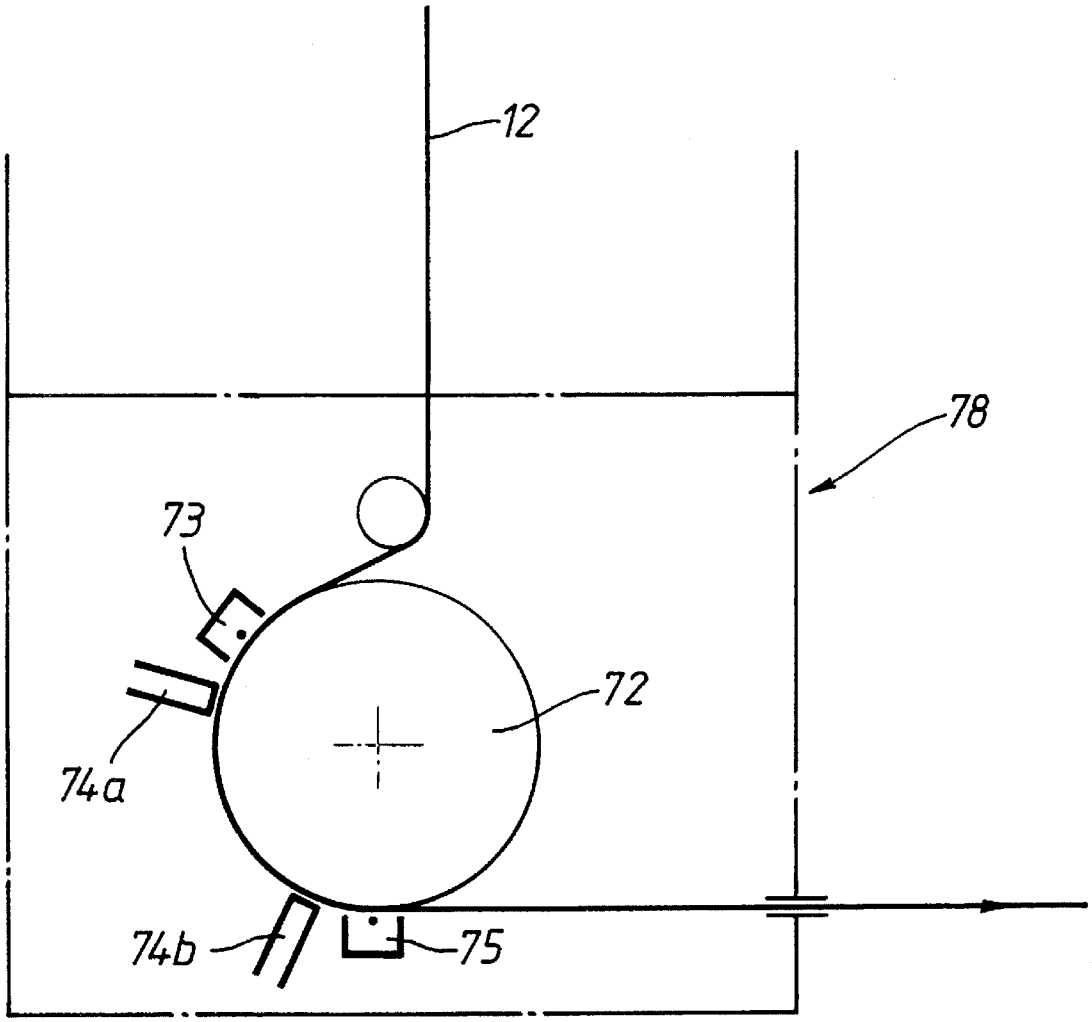
FIG. 4 shows a modification of part of the apparatus shown in FIG. 3, according to an alternative embodiment of the invention.

In the alternative embodiment shown in FIG. 4, two spaced electrometer heads **74*a* and 74*b* are positioned adjacent the paper web path downstream of the corona discharge unit 73. In this embodiment, the control device (not shown in FIG. 4) compares the signals received from the two electrometers 74*a* and 74*b* to determine the rate of decay of electrostatic charge on the paper web. This rate of decay, being indicative of the electrical condition of the paper web, is then used to automatically adjust the heat energy supply in accordance with the rate of charge decay sensed by the electrometer heads 74*a*, 74*b*** to bring the condition of the paper within the desired range.

The embodiment shown in FIG. 4 has the advantage over that shown in FIG. 3, of not requiring previous calibration.

CROSS-REFERENCE TO CO-PENDING APPLICATIONS

A number of features of the printers described herein are the subject matter of co-pending European patent application Nos: 93304771.4 entitled "Electrostatographic single-pass multiple-station printer"; 93304772.2 entitled "An electrostatographic single-pass multiple station printer for duplex printing"; 93304773.0 entitled "Electrostatographic single-pass multiple station printer with register control"; and 93304775.5 entitled "Electrostatographic printer for forming an image onto a moving receptor element", all filed on 18 June 1993.

We claim:

1. A receptor material conditioning apparatus for conditioning a moving paper receptor material suitable for use in an electrostatographic printer, said apparatus comprising:

means defining a receptor material path through said apparatus;

heating means for reducing the moisture content of said receptor material moving along said receptor material path;

cooling means, positioned downstream of said heating means, for cooling said receptor material moving along said receptor material path to provide said receptor material with a predetermined electrical condition;

sensing means, positioned downstream of said cooling means, to sense said predetermined electrical condition of said receptor material; and control means for controlling said heating means in response to said predetermined electrical condition of said receptor material sensed by said sensing means.

2. A receptor material conditioning apparatus according to claim 1, wherein said receptor material is in the form of a web.

3. A receptor material conditioning apparatus according to claim 1, wherein said heating means is enclosed in a heating cabinet having a receptor material entrance, a receptor material exit, means for the entrance of fresh air and exhaust means for expelling moist air produced by heating said receptor material.

4. A receptor material conditioning apparatus according to claim 1, wherein said cooling means comprises a cooling cabinet comprising means for cooling the heated receptor material with dry air to bring its temperature within the range of 15° to 30° C. before leaving said apparatus.

5. A receptor material conditioning apparatus according to claim 1, wherein said heating means is enclosed in a heating cabinet having a receptor material entrance, a receptor material exit, means for the entrance of fresh air, and exhaust means for expelling moist air produced by heating said receptor material;

said cooling means comprises a cooling cabinet comprising means for cooling the heated receptor material with dry air to bring its temperature within the range of 15° to 30° C. before leaving said apparatus; and said cooling cabinet is connected to said heating cabinet.

6. A receptor material conditioning apparatus according to claim 1, wherein said heating means comprises a heated rotatable drum in contact with at least one side of said receptor material as it moves along said receptor material path.

7. A receptor material conditioning apparatus according to claim 1, wherein said heating means comprises a radiant-heat dryer having at last one radiant-heat source positioned to project infrared radiation onto at least one side of said receptor material as it moves along said receptor material path.

8. A receptor material conditioning apparatus according to claim 7, wherein said radiant-heat source has a dominant energy output wavelength within the range of from 1.5 μm to 10 μm.

9. A receptor material conditioning apparatus according to claim 1, wherein said sensing means is positioned for determining the electrical condition of said receptor material before it leaves said apparatus.

10. A receptor material conditioning apparatus according to claim 9, wherein said sensing means comprises a corona discharge device positioned adjacent said receptor material path to build up a predetermined electrostatic charge on at least one side of said receptor material and means positioned downstream of said corona discharge device for sensing electrostatic charge retained on said receptor material.

11. A receptor material conditioning apparatus according to claim 10, wherein said sensing means comprises a corona discharge device positioned adjacent said receptor material path to build up a predetermined electrostatic charge on at least one side of said receptor material and means positioned downstream of said corona discharge device for sensing decay of electrostatic charge on said receptor material.

12. A receptor material conditioning apparatus according to claim 11, wherein said means for sensing the decay of electrostatic charge on said receptor material comprises a plurality of spaced electrometers positioned adjacent said receptor material path and means for comparing output signals from said electrometers.

13. A receptor material conditioning apparatus according to claim 10, wherein a charge discharging device is positioned downstream of said charge sensing means for discharging the static charge on said receptor material before it leaves said apparatus.

14. A receptor material conditioning apparatus according to claim 1, coupled to an electrostatographic printer for forming an image onto a paper receptor material, which printer comprises:

at least one toner image-producing electrostatographic station having rotatable endless surface means onto which a toner image can be formed;

means for conveying said receptor material past said stations; and means for transferring said toner image on said rotatable surface means onto said receptor material.

15. A method for conditioning a moving paper receptor material for use in an electrostatographic printer, said method comprising:

moving said receptor material along a receptor material path through a conditioning apparatus;

heating said receptor material along said receptor material path to reduce the moisture content thereof;

subsequently cooling said receptor material along said receptor material path to provide said receptor material with a predetermined electrical condition;

subsequently sensing said predetermined electrical condition of said receptor material; and controlling said heating and cooling of said receptor material in response to said sensed predetermined electrical condition.

* * * * *